US005381736A

United States Patent [19]

Kalcic

[11] Patent Number: 5,381,736

[45] Date of Patent: Jan. 17, 1995

[54] RECOIL REDUCING BULLET

[76] Inventor: Frank Kalcic, 7 Eagle Dr., Merrimack, N.H. 03054

[21] Appl. No.: 185,476

[22] Filed: Jan. 24, 1994

[51] Int. Cl.[6] ..... F42B 10/00; F42B 5/05

[52] U.S. Cl. ..... 102/501; 102/437

[58] Field of Search ..... 102/437, 439, 448–463, 102/501, 502, 503, 517, 520, 521, 522, 523, 529, 532; 244/3.23

[56] References Cited

U.S. PATENT DOCUMENTS

| | | | |
|---|---|---|---|
| 1,450,558 | 4/1923 | Maze | 89/143 |
| 2,110,264 | 3/1938 | Gerlich | 102/501 |
| 2,507,878 | 5/1950 | Banning, Jr. | 102/517 |
| 2,798,433 | 7/1957 | Allan | 102/522 |
| 3,398,682 | 8/1968 | Abela | 102/439 |
| 4,296,893 | 10/1981 | Ballmann | 102/501 |
| 4,506,605 | 3/1985 | Maki | 102/457 |
| 4,587,905 | 5/1986 | Maki | 102/448 |
| 4,813,635 | 3/1989 | Paterson et al. | 102/501 |

FOREIGN PATENT DOCUMENTS

| | | | |
|---|---|---|---|
| 468310 | 7/1914 | France | 102/503 |
| 22394 | 7/1921 | France | 102/503 |
| 1111889 | 3/1956 | France | 102/462 |
| 0002401 | of 1863 | United Kingdom | 102/501 |

*Primary Examiner*—Harold J. Tudor

*Attorney, Agent, or Firm*—Davis, Bujold & Streck

[57] ABSTRACT

A projectile is provided with an axially passage extending from the rear surface of the projectile and offset from the longitudinal axis of the projectile. A plurality of symmetrically arranged radially extending passages are arranged around the periphery of the projectile and intersect at the longitudinal axis and with the inner end of the axially extending passage to form passageways through the projectile for gradually releasing propellent gas from the barrel of the gun, to the atmosphere, as the projectile passes out the end of the barrel, thereby decreasing the recoil of the firearm.

4 Claims, 2 Drawing Sheets

RECOIL REDUCING BULLET

FIELD OF THE INVENTION

This invention relates to projectiles, to be fired from a firearm barrel, designed to reduce the recoil of the firearm.

1. Background of the Invention

Accepted theory is that the recoil of a firearm is caused by the violent escape of gases at the moment when the projectile fully clears the barrel. Prior art firearms have attempted to reduce the recoil or to minimize the effect of the recoil by modifying the firearm's barrel.

2. Summary of the Invention

In order to reduce the recoil of a firearm, the present invention provides projectile having a radially offset axially extending passage extending from an opening in the rear surface of the projectile and a plurality radially extending symmetrically arranged passages opening in the cylindrical side surface of the projectile. The axially extending passage and the radially extending passages meet in the interior of the projectile forming passages that run through the projectile, namely, in through the rear surface of the projectile, through the axially extending passage, into the radial passages and out the sides of the projectile.

The radially extending passages are located in the cylindrical portion of the projectile such that the openings are sealed by the interior of the barrel as the projectile travels therethrough under the force of the propellant gases. As the projectile exits the end of the barrel exterior openings of the radially extending passages clear the end of the barrel while the projectile is still partially in the barrel. At this point, propellent gases flow through the axial passages, into the radial passages, and out the cylindrical surface of the projectile, thereby releasing some of the propellent gases from the barrel and decreasing the mass and pressure of the gases in the barrel as the projectile passes out the end of the barrel. Thus, when the projectile completely exits the barrel the mass and pressure of the gases within the barrel have been decreased, and the escape of the gases from the barrel is not as violent as it would have been had not a portion of the gases been allowed to escape and the recoil of the firearm is thereby reduced.

In a further embodiment of the invention, symmetrically arranged axially extending grooves are provided, in the cylindrical sides of the projectile, that are open at the rear surface of the projectile. The grooves provide additional passages for propellent gases to exit the barrel as the projectile passes out the end of the barrel, thereby further decreasing the recoil of the firearm.

BRIEF DESCRIPTION OF THE DRAWINGS

The invention will now be described in detail, by way of example, with reference to the accompanying drawings, in which.

DETAILED DESCRIPTION OF THE INVENTION

Figure 2:
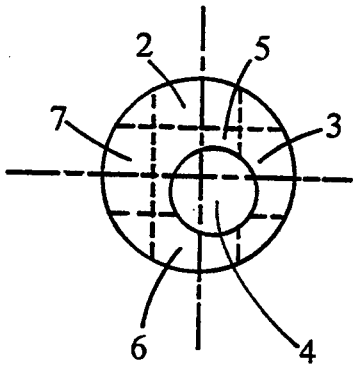
FIG. 2 is a rear view of the projectile shown in FIG. 1.
Figure 1:
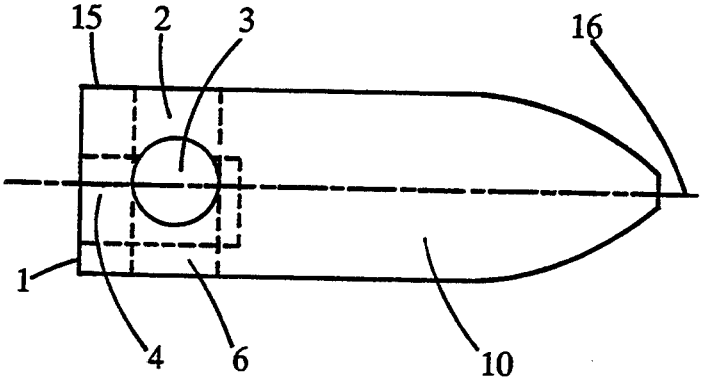
FIG. 1 is a side view of a projectile according to the invention.

FIGS. 1 and 2 show a projectile 10 according to the invention having an axially extending closed end (blind) passage 4 extending from the rear surface 1 of the projectile parallel to the longitudinal axis 16 of the projectile and offset from that longitudinal axis. Radially extending passages 2, 3, 6 and 7 connect with passage 4 and extend from the cylindrical outer surface of the projectile. The passages 2, 3, 6 and 7 are symmetrically arranged and are centered on and intersect at the longitudinal axis 16 of the projectile forming a common chamber 5 centrally of the diameter of the projectile 10.

The radially extending passages 2, 3, 6 and 7 are formed in a cylindrical portion of the projectile. By forming the radial passages in the cylindrical portion of the projectile these passages are sealed by the interior surface of the firearm barrel 31 when the projectile is therein. In this way, the propellent gases cannot pass through the passageways in the projectile when the projectile is in the barrel. All of the propellent gases are thereby contained within the barrel, and the passages in the projectile, and act to accelerate the projectile, until the projectile begins to exit the end of the barrel.

Preferably, passage 4 relative to the projectile axis is deliberately eccentric by approximately 15% of the projectile outside diameter. In addition, passage 4's diameter is approximately 30% of the projectile outside diameter and its depth is approximately 35% of the overall length of the projectile. The radially extending passages 2, 3, 6 and 7 are, preferably disposed adjacent the closed inner end of passage 4.

Figure 5:
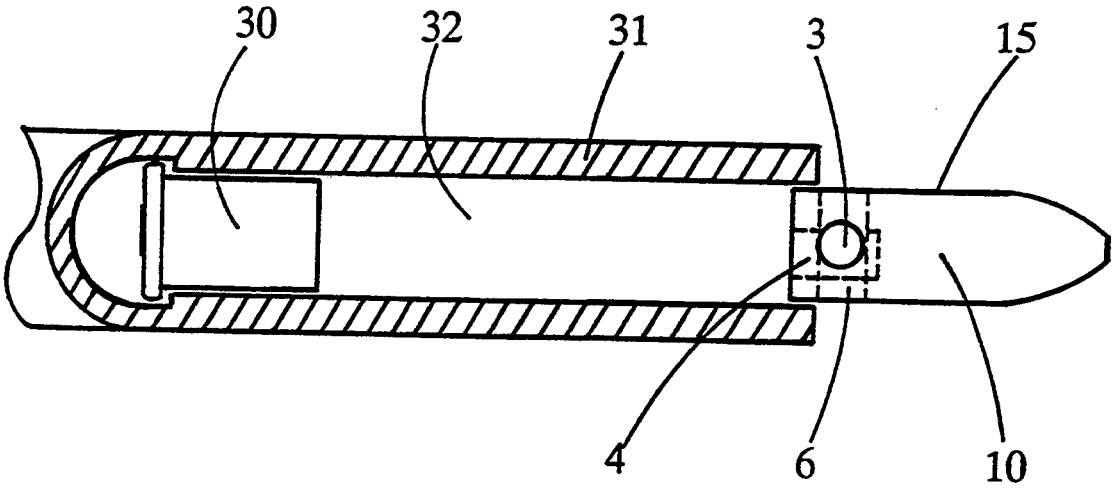
FIG. 5 is a longitudinal cross-sectional view of a firearm barrel showing a projectile according to the invention partially extending from the end of the gun barrel as it exits the gun barrel.
Figure 6:
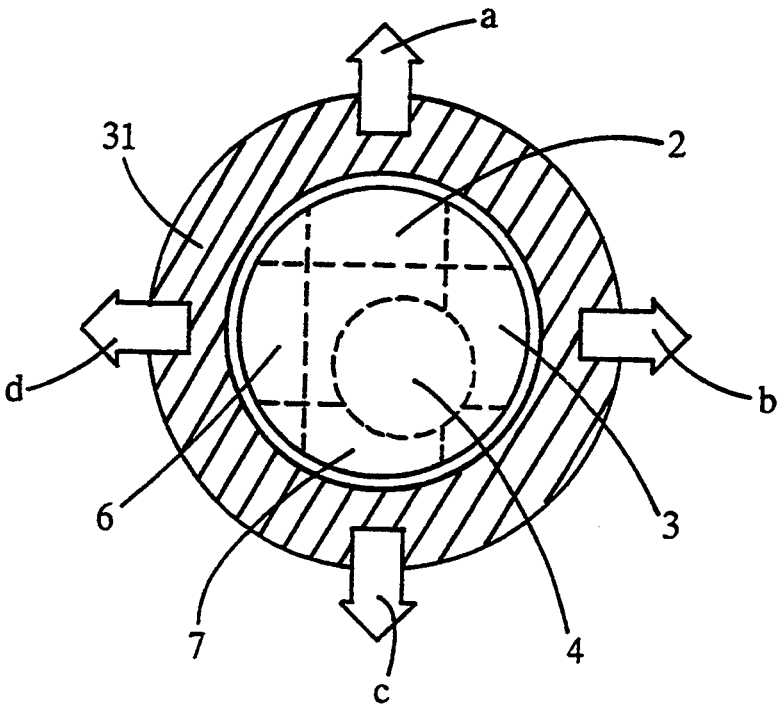
FIG. 6 is a front view of the gun barrel shown in FIG. 5.

As the projectile 10 exits the end of the barrel 31, the radial passages 2, 3, 6 and 7 clear the end of the barrel while the projectile is still partially therein (FIG. 5). Once the passages 2, 3, 6 and 7 begin to clear the end of the barrel 31, the propellent gases within chamber 32 of the gun barrel are gradually released through axial passage 4 and out through radial passages 2, 3, 6 and 7 in the direction of arrows a–c in FIG. 6. The pressure and mass of the propellent gases contained within the chamber 32 of the barrel 31 are thus decreased as the bullet is in the process of exiting the end of the gun barrel. The decrease in the mass and pressure of the propellent gases inside the chamber 32 of the barrel 31, causes the remaining propellent gases to escape from the end of the barrel when the projectile 10 completely exits the end of the barrel, much less violently than when a conventional bullet exits the barrel, greatly reducing the recoil of the firearm.

Figure 4:
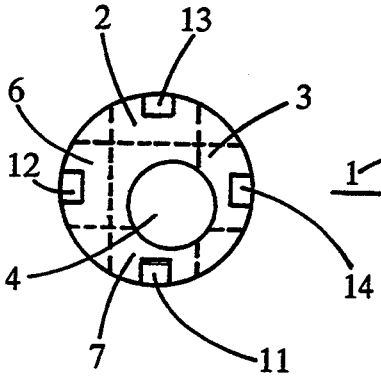
FIG. 4 is a rear view of the projectile shown in FIG. 3.
Figure 3:
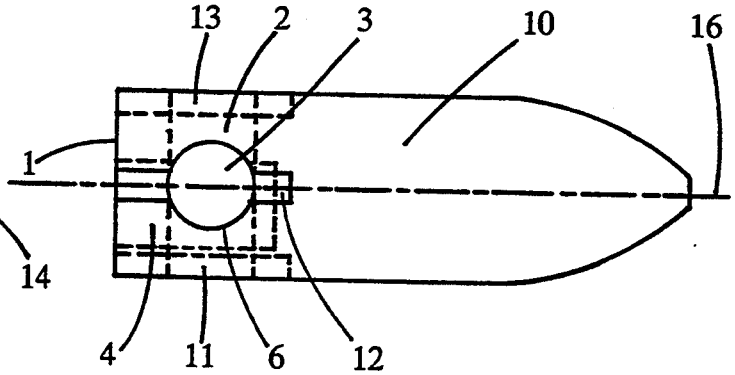
FIG. 3 is a side view of a second embodiment of the projectile according to the invention having grooves in the cylindrical surface of the projectile.

FIGS. 3 and 4 show a second embodiment of a projectile according to the invention with similar elements being indicated with the same reference numbers as in FIGS. 1 and 2. In the second embodiment of the invention, symmetrically arranged axially extending grooves 11, 12, 13, 14 are provided in the cylindrical surface of the projectile 10. The grooves 11–14 are open at the rear surface of the projectile 10 and extend partially along the cylindrical portion 15 to and beyond the radial passages 2, 3, 6 and 7.

The grooves 11–14 are aligned and interconnect with the radial passages 2, 3, 6 and 7. The grooves 11–14 serve the same purpose as the passages 2, 3, 4, 6 and 7, namely, to allow gradual release of the propellent gases in the chamber 32 of a barrel 31 as the projectile 10 exits the end of the barrel 31. Thus, the addition of the grooves 11–14 to the projectile of the first embodiment allows for the gradual release of more propellent gases, further reducing the recoil of the firearm.

A variety of hole and slot combinations have been shown in experimental tests to dramatically reduce (in excess of 50%) the recoil of firearms. It can be appreciated by one of ordinary skill in the art that there are many possible arrangements of radially extending passages to vent the propellent gases at the sides of the projectile. Likewise, it can be appreciated that many arrangements of grooves can be formed in the sides of the projectile.

The holes and slots may be created by any appropriate manufacturing process. The location, quantity and orientation of the holes and/or slots depend on the type, length and diameter of the projectile or bullet.

As used herein "projectile" is intended not only to include "bullet" but also, for example, the wad exiting a shotgun barrel.

I claim:

1. A projectile for reducing the recoil of a firearm comprising:

a substantially cylindrical portion defining a central longitudinal axis and a rear surface normal to said longitudinal axis;

a single axially extending blind passage extending from the rear surface along said cylindrical portion;

a plurality of radially extending symmetrically arranged passages in the cylindrical portion, said radially extending passages extending from a circumferential surface of the cylindrical portion and intersecting at the longitudinal axis; wherein said axially extending passage is offset from said longitudinal axis and interconnects with the radially extending passages to form passageways through said projectile, which are closed when the projectile is fully within a barrel of the firearm.

2. A projectile according to claim 1, wherein said radially extending passages are defined by at least one diametrically arranged transverse passageway of constant cross-section.

3. A projectile according to claim 2, wherein there are two mutually perpendicular such transverse passageways.

4. A projectile according to claim 1, further comprising:

axially extending grooves in the circumferential surface of the cylindrical portion, the grooves being symmetrically arranged around the circumference of the cylindrical portion, open at said rear surface, and extending at least to a plane normal to the longitudinal axis in which the radial passages lie.

* * * * *